US007977295B2

(12) United States Patent
Classen

(10) Patent No.: US 7,977,295 B2
(45) Date of Patent: Jul. 12, 2011

(54) METHOD FOR MECHANICAL CLEANING OF TEXTILES OR SOLID OBJECTS COMPRISING ENCAPSULATED ENZYMES

(75) Inventor: Egbert Classen, Wertingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 11/713,338

(22) Filed: Mar. 2, 2007

(65) Prior Publication Data

US 2007/0155642 A1 Jul. 5, 2007

Related U.S. Application Data

(60) Division of application No. 10/422,210, filed on Apr. 24, 2003, now abandoned, which is a continuation of application No. PCT/EP01/12365, filed on Oct. 25, 2001.

(30) Foreign Application Priority Data

Oct. 27, 2000 (DE) ..... 100 53 416

(51) Int. Cl.
*C11D 3/386* (2006.01)

(52) U.S. Cl. ..... 510/226; 510/220; 510/276; 510/300; 510/305; 510/320; 510/349; 510/392; 68/9; 68/27; 134/94.1; 222/651; 222/638; 8/158

(58) Field of Classification Search ..... 510/220, 510/226, 276, 300, 305, 320, 349, 392; 68/9, 68/27; 134/94.1; 222/651, 638; 137/624.18; 8/158
See application file for complete search history.

(56) References Cited

U.S. PATENT DOCUMENTS

| | | | | | |
|---|---|---|---|---|---|
| 3,567,076 | A | * | 3/1971 | Zanussi | 222/144 |
| 3,727,434 | A | * | 4/1973 | Bochan | 68/17 R |
| 3,747,645 | A | * | 7/1973 | Holster et al. | 137/838 |
| 3,942,341 | A | * | 3/1976 | Sang | 68/17 R |
| 3,950,277 | A | * | 4/1976 | Stewart et al. | 8/137 |
| 4,016,040 | A | * | 4/1977 | Win et al. | 510/530 |
| 4,107,065 | A | * | 8/1978 | Gray | 510/313 |
| 4,365,853 | A | * | 12/1982 | Ehrlich | 312/42 |
| 4,745,021 | A | | 5/1988 | Ping, III et al. | |
| 4,756,844 | A | | 7/1988 | Walles et al. | |
| 4,759,202 | A | * | 7/1988 | Caron | 68/17 R |
| 4,777,682 | A | * | 10/1988 | Dreher et al. | 8/158 |
| 5,078,301 | A | * | 1/1992 | Gladfelter et al. | 222/52 |
| 5,133,892 | A | * | 7/1992 | Chun et al. | 510/224 |
| 5,208,930 | A | * | 5/1993 | Chabard | 8/158 |
| 5,388,298 | A | * | 2/1995 | Rutter et al. | 8/158 |
| 5,687,590 | A | * | 11/1997 | Borroni et al. | 68/17 R |
| 5,768,917 | A | * | 6/1998 | Freida | 68/17 R |
| 5,887,753 | A | * | 3/1999 | Poolman | 222/1 |
| 6,277,153 | B1 | * | 8/2001 | Van Kouwen et al. | 8/137 |

FOREIGN PATENT DOCUMENTS

| | | | |
|---|---|---|---|
| DE | 4219620 | A1 | 12/1993 |
| DE | 4324202 | A1 | 12/1994 |
| DE | 19907764 | A1 | 11/1999 |
| EP | 0976819 | A1 | 2/2000 |
| EP | 0979866 | A1 | 2/2000 |
| GB | 2254857 | A | 10/1992 |
| GB | 2339579 | A | 2/2000 |
| WO | 96/15710 | | 5/1996 |
| WO | 00/50557 | | 8/2000 |
| WO | 01/25527 | A1 | 4/2001 |
| WO | 02/29150 | A1 | 4/2002 |

OTHER PUBLICATIONS

"Waschmittelchemie", Dr. Alfred Hüthig Verlag, Heidelberg 1976, pp. 166 and 167.

* cited by examiner

*Primary Examiner* — Charles I Boyer
(74) *Attorney, Agent, or Firm* — James E. Howard; Andre Pallapies

(57) ABSTRACT

Water-soluble detergents and enzymes are used for mechanically cleaning textiles or crockery. According to the invention, enzymes with a catalytic effect on typical stains are added to the washing or cleaning process, only for as long as their catalytic effect is desired. This avoids superfluous removal of the enzymes that have been used in a washing or cleaning process.

20 Claims, 1 Drawing Sheet

Figure 1:
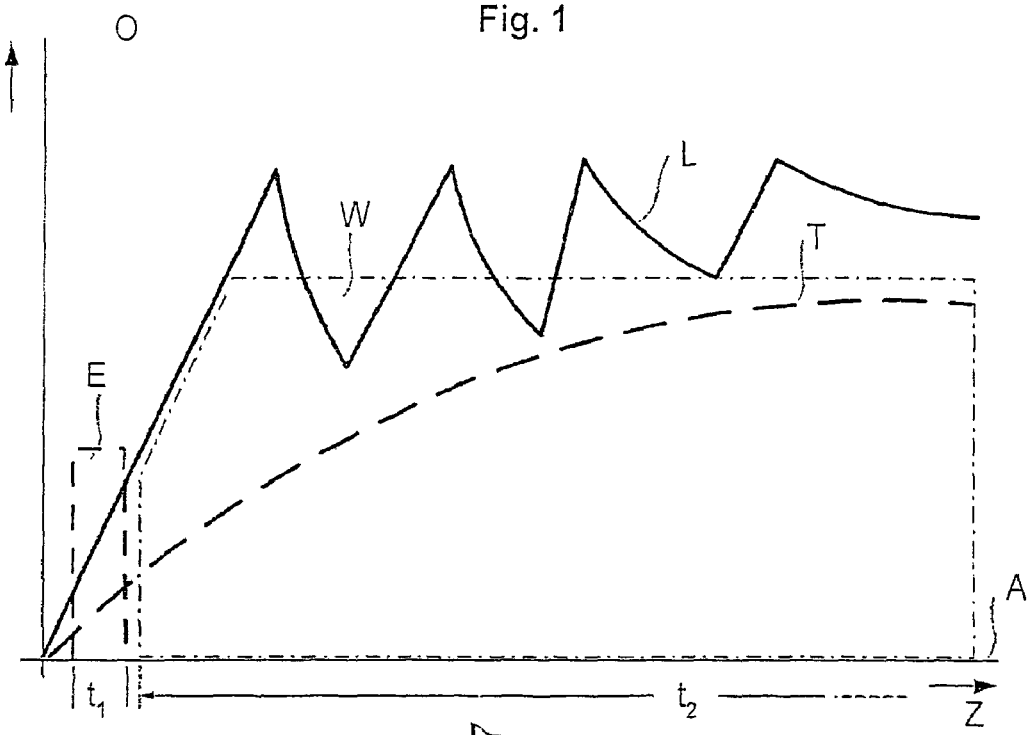

METHOD FOR MECHANICAL CLEANING OF TEXTILES OR SOLID OBJECTS COMPRISING ENCAPSULATED ENZYMES

This application is a Divisional, under 35 U.S.C. §121, of U.S. application Ser. No. 10/422,210, filed Apr. 24 2003, which is a continuation, under 35 U.S.C. §120 of International Application No. PCT/EP01/12365 , filed Oct. 25, 2001, which designated the United States; this application also claims the priority, under 35 U.S.C. §119, of German patent application No. 100 53 416.3, filed Oct. 27, 2000; the prior applications are herewith incorporated by reference in their entirety.

The invention is based on a method for mechanically cleaning textiles or solid objects such as crockery using water-soluble detergents and/or cleaning agents and enzymes.

Up to now, commonly used methods of the kind described above (DE 43 24 202 A1) have used enzymes to boost the cleaning effect of e.g. alkaline cleaning agents for the duration of the impact. In modern washing systems for instance, enzymes are added to the washing process in the form of a powder. Depending upon the type of staining different enzymes are required which means that adequate stock provisions are necessary and that the selection and metering operation is costly. Not only are carbohydrates and proteins dissolved or decomposed during the washing process, but due to the presence of alkaline cleaning agents the enzymes themselves are also attacked and either decomposed or, at the very least, rendered ineffective. Finally enzymes not destroyed are washed away with the washing liquid after each washing cycle and must therefore be continuously added again.

The invention is based on the requirement to prevent the enzymes from dissolving or becoming ineffective and to ensure that still usable enzymes are not washed away.

According to the invention the requirement is met in that catalytically active enzymes are added to the washing or cleaning process for removing typical stains, but only for as long as their catalytic effect is desired. Since the catalytic effect of the enzymes is of good use only in the low-temperature range and, if possible, without alkaline cleaning agents being present, the enzymes, once they have been put to use, may be removed again from the washing process and reused in a later washing process.

The method according to the invention may be employed in a particularly advantageous manner with a detergent or cleaning agent where the enzymes are macroscopically encapsulated by means of a polymer membrane which is permeable to washing liquids but insoluble in water. As a result the catalytic effect may be effected through the membrane without the enzymes dispersing in the washing or cleaning liquid.

If, according to a further advantageous development of the invention the capsules consist of several hollow bodies linked to one another, then this is the easiest way of keeping the enzyme-loaded membrane bodies separate from the circulating washing liquid, e.g. while this is being pumped out. The hollow bodies can thus be linked to form cartridges and/or bars and/or tubular bodies. In this way they become a larger unit which is easy to mechanically retain in the circulating washing liquid.

Furthermore, since with the application of the method according to the invention the enzymes become gradually exhausted, for which alkaline residues and temperature-dependent decomposition processes are responsible, the capsules or linked hollow bodies, according to a particularly advantageous development, may be stationarily but replaceably arranged at a location in a machine for cleaning textiles or solid objects (e.g. crockery), which is accessible to the washing or cleaning liquid.

In such a case, the location is best protected by a filter against insoluble impurities in the washing or cleaning liquid.

In order to cover all kinds of protein-based or carbohydrate-based stains in the enzyme-phase of the washing or cleaning process, the capsules or hollow bodies are preferably filled with enzymes suited to different kinds of stains. It is best to provide a specific enzyme for each kind of stain occurring in mechanically applied washing or cleaning processes.

With reference to an embodiment illustrated in the drawing both the method according to invention and a washing machine controllable by the method are schematically drawn. In the drawing FIG. 1 shows a time lapse diagram of the water inflow operations, the rising temperature progression and the sections for the addition of a cleaning agent or for the washing liquid to make contact with an enzyme-based detergent or cleaning agent according to the invention, and FIG. 2 shows a washing liquid container of a washing machine with water and detergent inflow connections and for circulating the washing liquid through an enzyme container.

Figure 2:
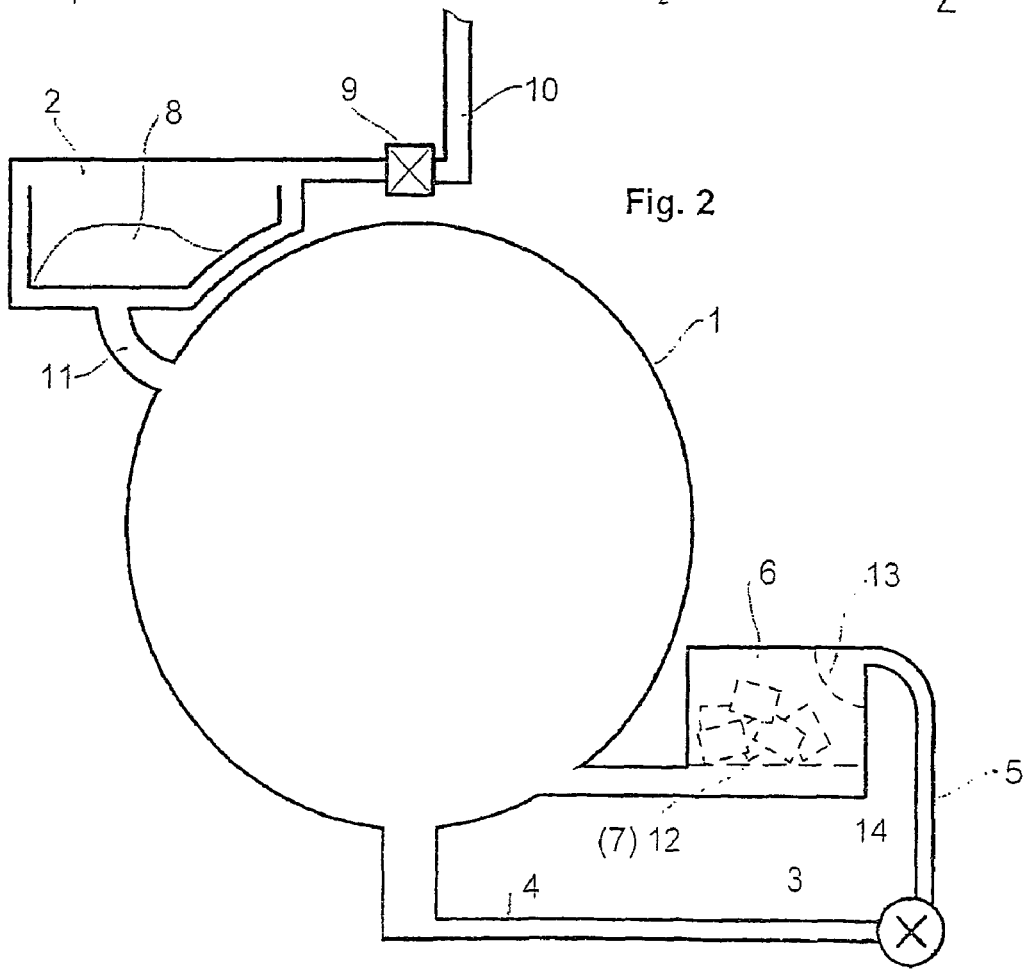

The ordinate O of the diagram in FIG. 1 contains scales not marked in detail for the quantity of washing liquid L in washing liquid container 1 of the washing machine shown in FIG. 2, for the temperature T of the washing liquid and for the respective quantities of detergents W and enzymes E. A time scale Z not marked in detail has been entered on the abscissa A.

The washing process illustrated in the diagram in FIG. 1 starts with water flowing into washing liquid container 1. As soon as a certain washing liquid level L has been reached, the washing liquid is brought into contact with a quantity of enzymatic detergent or cleaning agent E, which attacks protein and carbohydrate-based stains in a batch of washing, for a limited amount of time t1, during which the temperature of the washing liquid is still low. Thereafter an alkaline detergent W is e.g. introduced into the washing liquid L, and .this remains dissolved in the washing liquid over an undefined amount of time t2 while acting upon the dissolved proteins and carbohydrates as well as other stains in the batch of washing so as to remove the stains. The areas below the diagram lines for enzyme E and detergent W illustrate the difference between individual degrees of impact.

The inflow of water which bypasses a detergent container 2 for the first phase of the water inflow in FIG. 1 is not shown in FIG. 2. Once a certain amount of admitted water, however, covers the floor of washing liquid container 1 and has already wetted the washing, the washing liquid pump 3 in the example in FIG. 2 is switched on, and the admitted water, insofar as it is not absorbed by the washing, is fed to the enzyme container 6 through the discharge pipe 4 on the floor of the washing liquid container and the circulation pipe 5. There it takes up a limited quantity of the provisioned enzymes 7 and transports them into the washing liquid container 1, from where they are taken up by the batch of washing together with the washing liquid which is again wetting the washing. In this way the entire of batch of washing is gradually acted upon by enzymes due to the continuing exchange of water and washing liquid bound in the washing. During this process proteins and carbohydrates are split up. The enzyme phase finishes when the pump 3 is switched off.

After the enzyme phase is finished, detergent 8 is washed out of detergent container 2 due to water being admitted from water main 10 during opening of valve 9, and fed to washing liquid container 1 via pipe 11. Then, possibly while more water is being admitted to make up a desired quantity of washing liquid L, and while the washing liquid is being heated by means of a heater not shown up to a desired temperature T, the detergent W may act upon the split-up proteins and carbohydrates and upon the other stains in the batch of washing and remove them from the washing. Later on, they will be pumped out of the washing liquid container 1 together with the spent washing liquid into a waste water main in a manner not shown.

Innovations in process technology (Microsystems) may be utilised to cover enzymes 7 with a thin, porous polymer membrane which retains the enzymes in a capsule, but allows for an exchange of substances with the surroundings (required for the decomposition process of the proteins and carbohydrates during washing). Appropriate quantities of such macroscopic capsules may be combined in containers 12 (sieve-like cartridges or individual capsules linked together to form larger structures such as bars, tubular bodies etc.) to form bundles for the respective process and thus be retained as part of the machine in the hydraulic cycle 3 to 6. In order to protect the surface of the capsules against staining which would reduce or prevent an exchange of substances, suitable filters 13 might be arranged in front of the entry and 14 in front of the outlet of enzyme container 6, or a suitable design for the washing process might be found.

The method according to the invention and the associated detergent or cleaning agent thus include the possibility for completely avoiding regular additions of detergent by the customer. Neither conventional environment-polluting tenside detergents nor enzymatic detergents in the form of powder are required when using the method and the detergent or cleaning agent according to the invention. The still required detergent, e.g. in the form of cartridges, will continue to be used for supplying the machine with a treatment agent—perhaps not for the duration of the life of a washing machine or dishwasher, but certainly for a sustained period of time. Manual or automatic single-metering of detergents or cleaning agents according to the invention for each washing operation is no longer necessary, which means less work for the customer and more protection for the environment.

In order to meet the various requirements for enzymes depending upon the type of staining, each type of enzyme may be housed in its own structure or its own cartridge, or mixtures of different enzymes may be housed in one structure or one cartridge.

The invention claimed is:

1. A washing apparatus, for cleaning textiles or solid objects using enzymes and at least one of water-soluble detergents and cleaning agents, comprising:

a washing liquid container with a source of washing liquid;

an enzyme container configured to contain at least one capsule that retains catalytically-acting enzymes, the at least one capsule of said catalytically-acting enzymes being permeable to said washing liquid but insoluble in water;

a detergent container to contain at least one of water-soluble detergents and cleaning agents; and a pump connected between the washing liquid container and the enzyme container, the pump configured to circulate the washing liquid between the washing liquid container and the enzyme container and back to the washing liquid container for a first time period of a washing process to transport a limited quantity of the enzymes retained in the at least one capsule into the washing liquid container for the first time period, and before additional washing liquid is added through the detergent container to wash at least one of the water-soluble detergents and cleaning agents out of the detergent container and into said washing liquid container in said washing or cleaning process for a second time period.

2. The apparatus according to claim 1, wherein the at least one capsule comprises a polymer membrane which is permeable to said washing liquid but insoluble in water.

3. The apparatus according to claim 2, wherein the at least one capsule comprises a plurality of hollow body capsules linked to one another.

4. The apparatus according to claim 3, wherein the plurality of hollow body capsules are linked to form at least one of cartridges, bars and tubular bodies.

5. The apparatus according to claim 3, wherein the plurality of hollow body capsules are stationarily and replaceably located in said enzyme container accessible to said circulating washing liquid.

6. The apparatus according to claim 5, wherein the enzyme container comprises at least one filter for filtering out insoluble impurities from said washing liquid at least as said washing liquid is circulated into or out of said enzyme container.

7. The apparatus according to claim 6, wherein the at least one filter comprises a first filter for filtering out the insoluble impurities from said washing liquid as said washing liquid is circulated into said enzyme container and a second filter for filtering out the insoluble impurities from said washing liquid as said washing liquid is circulated out of said enzyme container.

8. The apparatus according to claim 2, wherein the at least one capsule retains a plurality of different enzymes suitable to act on various different types of stains.

9. The apparatus according to claim 8, wherein the plurality of different enzymes include a specific enzyme for each type of stain occurring in said washing liquid in said washing process.

10. A washing apparatus for cleaning textiles or solid objects using enzymes and at least one of water-soluble detergents and cleaning agents, the washing apparatus comprising:

a washing liquid container configured to contain the textiles or solid objects, the washing liquid container being configured to receive a washing liquid;

an enzyme container containing at least one capsule that retains catalytically-acting enzymes, the enzyme container being connected to the washing liquid container, and the at least one capsule being permeable to said washing liquid but insoluble in water;

a pump connected to the washing liquid container and to the enzyme container, the pump being configured to circulate the washing liquid between the washing liquid container and the enzyme container to transport a limited quantity of the enzymes from the enzyme container to the washing liquid container for a first time period in a first washing or cleaning process for removing typical stains, the pump being configured to begin circulating the washing liquid when a level of the washing liquid being added to the washing liquid container reaches a predetermined level; and a detergent container configured to contain a supply of water-soluble detergent and/or cleaning agents, wherein the pump is configured to stop circulating the washing liquid between the washing liquid container and the enzyme container after the first time period and before the water-soluble detergents and/or cleaning agents are added to the washing liquid container for a second time period.

11. The apparatus according to claim 10, wherein the at least one capsule macroscopically encapsulates the enzymes in a polymer membrane which is permeable to the washing liquid but insoluble in water.

12. The apparatus according to claim 11 wherein the at least one capsule comprises a plurality of hollow body capsules linked to one another.

13. The apparatus according to claim 12, wherein the plurality of hollow body capsules are linked to form at least one of cartridges, bars and tubular bodies.

14. The apparatus according to claim 12, wherein the plurality of hollow body capsules are stationarily and replaceably located in the enzyme container accessible to the circulating washing liquid.

15. The apparatus according to claim 10, wherein the enzyme container comprises at least one filter for filtering out insoluble impurities from the washing liquid at least as the washing liquid is circulated into or out of the enzyme container.

16. The apparatus according to claim 15, wherein the at least one filter comprises a first filter for filtering out the insoluble impurities from the washing liquid as the washing liquid is circulated into the enzyme container and a second filter for filtering out the insoluble impurities from the washing liquid as the washing liquid is circulated out of the enzyme container.

17. The apparatus according to claim 11, wherein a plurality of different enzymes suitable to act on various different types of stains are macroscopically encapsulated.

18. The apparatus according to claim 17, wherein the plurality of different enzymes includes a specific enzyme for each type of stain occurring in the washing liquid.

19. The apparatus according to claim 10, wherein the washing liquid container is connected to the pump by a first pipe and the enzyme container is connected to the pump by a second pipe.

20. The apparatus according to claim 10, further comprising a valve configured to control a flow of the washing liquid to the detergent container.

* * * * *